US005819371A

United States Patent [19]

Röck et al.

[11] Patent Number: 5,819,371

[45] Date of Patent: Oct. 13, 1998

[54] HINGE

[75] Inventors: Erich Röck, Höchst, Austria; Fredi Dubach, Adetswil, Switzerland

[73] Assignee: Julius Blum Gesellschaft M.B.H., Höchst, Austria

[21] Appl. No.: 800,281

[22] Filed: Feb. 13, 1997

[30] Foreign Application Priority Data

Feb. 14, 1996 [AT] Austria ..... 257/96

[51] Int. Cl.[6] ..... E05D 7/10

[52] U.S. Cl. ..... 16/258; 16/382

[58] Field of Search ..... 16/258, 257, 382, 16/389, DIG. 43

[56] References Cited

U.S. PATENT DOCUMENTS

| | | | |
|---|---|---|---|
| 2,131,802 | 10/1938 | Harmon | 16/258 |
| 4,654,932 | 4/1987 | Röck et al. | 16/258 |
| 4,882,808 | 11/1989 | Rock et al. | 16/382 |
| 5,025,530 | 6/1991 | Ferrari et al. | 16/258 |
| 5,056,189 | 10/1991 | Brustle et al. | 16/258 |
| 5,088,155 | 2/1992 | Grass | 16/257 |
| 5,454,144 | 10/1995 | Rupprechter | 16/382 |
| 5,577,296 | 11/1996 | Grass | 16/258 |

FOREIGN PATENT DOCUMENTS

| | | | |
|---|---|---|---|
| 0 043 903 A | 1/1982 | European Pat. Off. . | |
| 0 256 376 A | 2/1988 | European Pat. Off. . | |
| 0256376B1 | 2/1988 | European Pat. Off. | 16/258 |
| 0 369 532 | 5/1990 | European Pat. Off. . | |
| 27 33 831 A | 3/1978 | Germany . | |
| 40 04 197 A | 8/1990 | Germany . | |
| 40 31 305 A | 4/1992 | Germany . | |

*Primary Examiner*—Chuck Mah

*Attorney, Agent, or Firm*—Wenderoth, Lind & Ponack, L.L.P.

[57] ABSTRACT

A hinge to be mounted on a frame of a piece of furniture includes a hinge arm which is mounted on a mounting plate and is lockable on the mounting plate. The hinge arm is articulated by means of at least one hinge axle to a hinge member which is fastenable to a door. The hinge arm or the mounting plate is provided with pegs having slots into which a spring activated latching member which is movable parallel to the mounting plate is engageable, thus locking the hinge arm to the mounting plate. The mounting plate and the hinge arm are of rectangular configuration with two longer sides and two shorter sides, whereby the longer sides of the mounting plate and the hinge arm are aligned parallel to the hinge axis. The mounting plate is provided on its longer sides with webs extending perpendicular to the mounting plate for abutment with the frame when in mounted position. The latching member is provided with a handle situated at one of the long sides of the hinge arm.

31 Claims, 12 Drawing Sheets

Fig. 25
Fig. 26
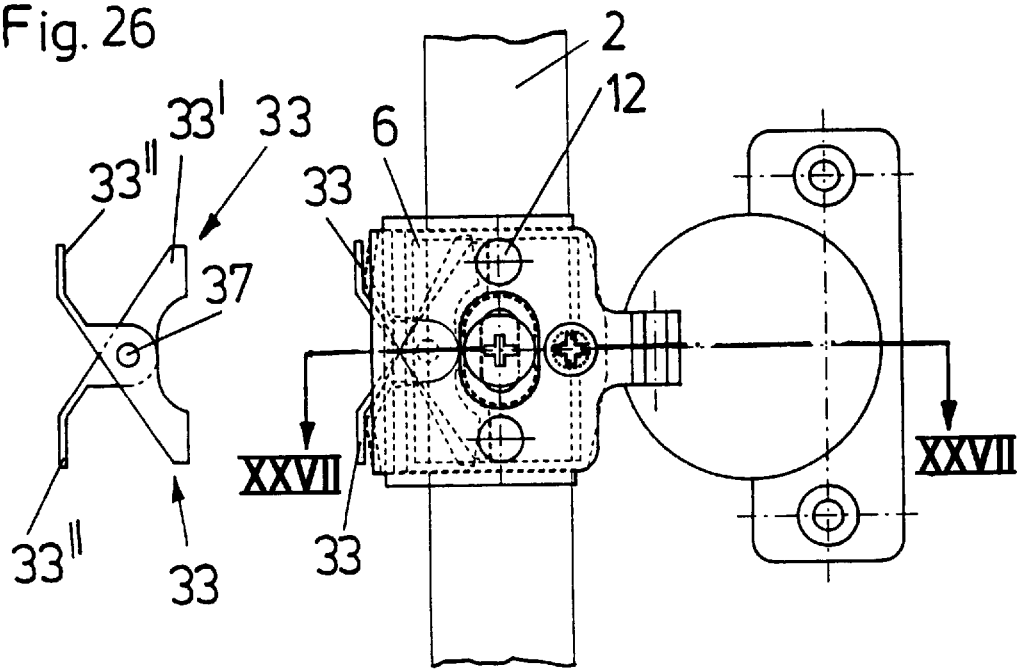
Fig. 27
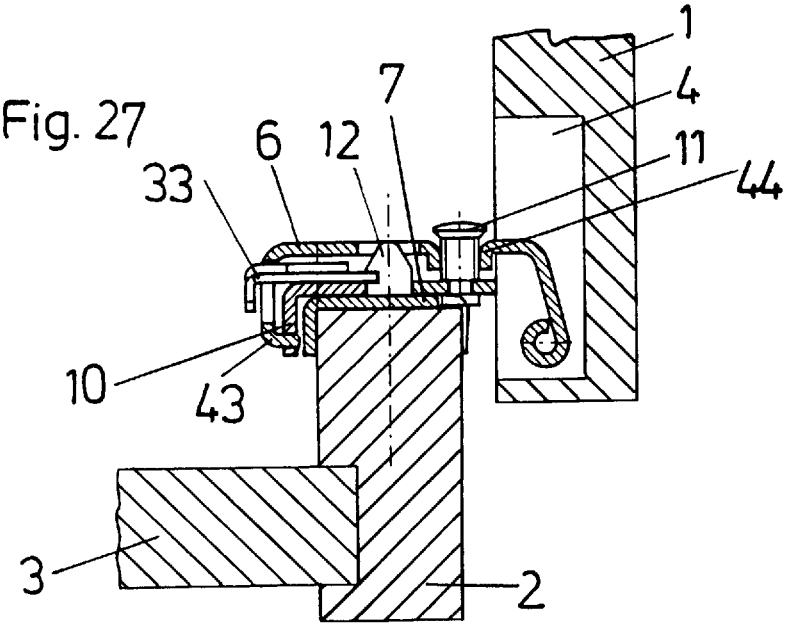

Fig. 28
Fig. 29
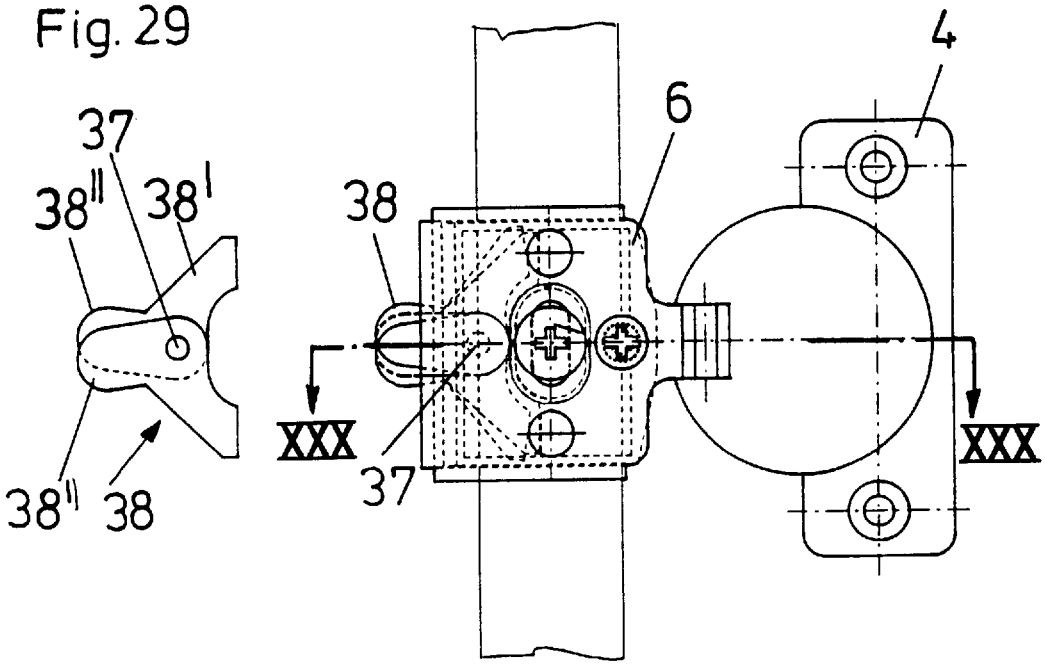
Fig. 30
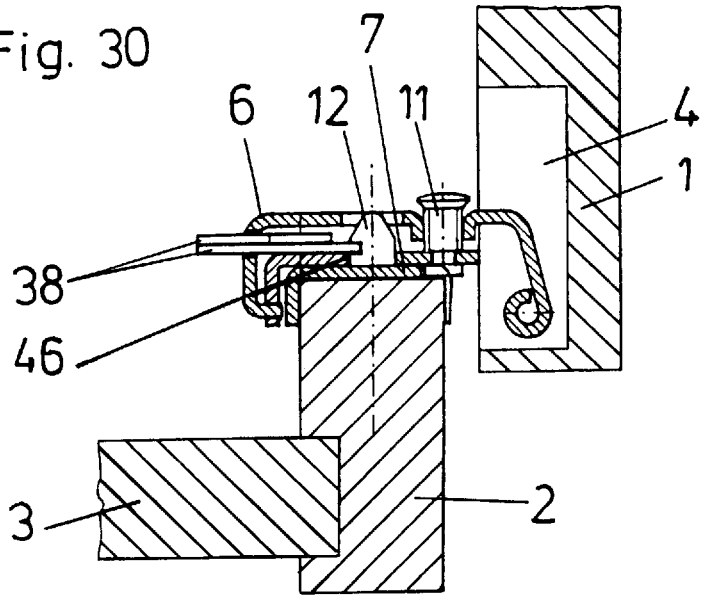

Fig. 31
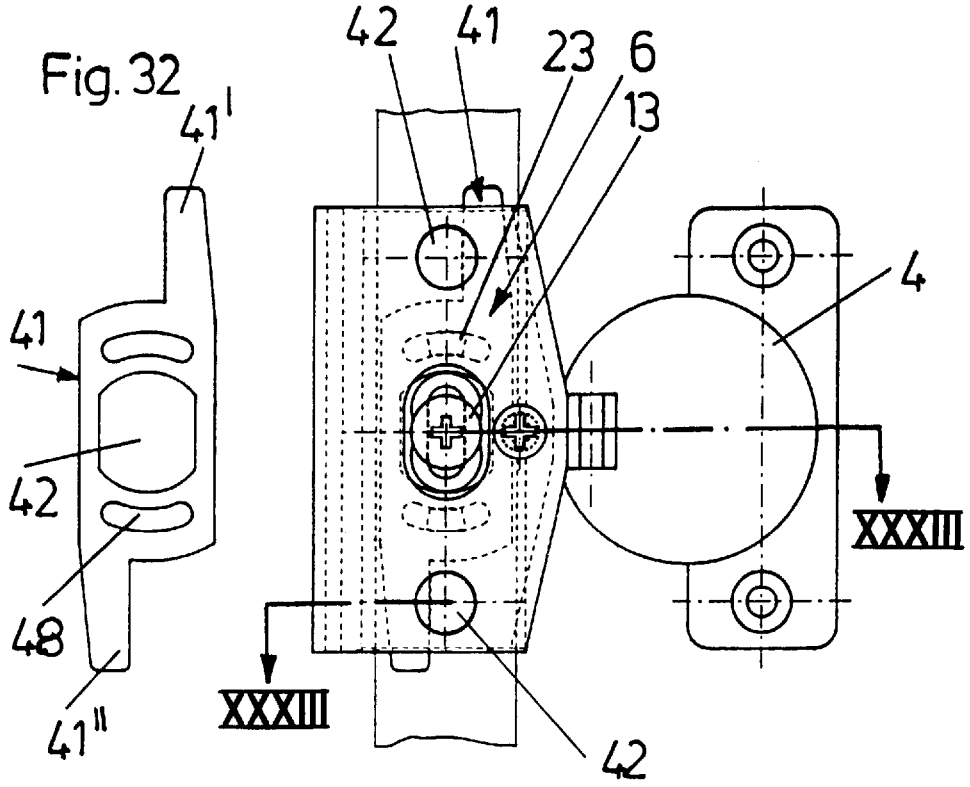
Fig. 32
Fig. 33
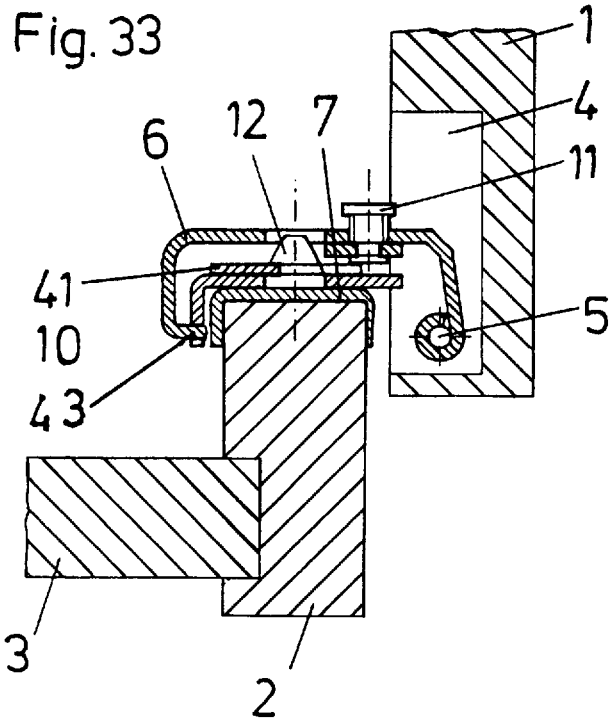

HINGE

BACKGROUND AND FIELD OF THE INVENTION

This invention relates to a hinge to be mounted on a frame of a piece of furniture, an including a hinge arm mountable on a mounting plate and lockable on the mounting plate by means of a spring activated latching member.

DESCRIPTION OF THE PRIOR ART

A hinge is known from U.S. Pat. No. 4,654,932 in which a hinge arm is lockable on a mounting plate by means of a spring activated catch mechanism. The mounting plate is fastened to a side wall of a piece of furniture. U.S. Pat. No. 5,454,144 shows a hinge with a hinge arm which is mountable on a frame of a piece of furniture.

SUMMARY OF INVENTION

It is the object of the invention to provide an improved hinge with a hinge arm that is mountable on a frame of a piece of furniture by providing an adapted spring catch mechanism.

BRIEF DESCRIPTION OF THE DRAWINGS

An embodiment of the invention now will described in more detail with reference to the accompanying drawings, in which:

FIG. 25 is a plan view of a hinge according to a further embodiment of the invention;

FIG. 26 is a plan view of a tilting lever of this embodiment;

FIG. 27 is a sectional view along line XXVII—XXVII of FIG. 25;

FIG. 28 is a plan view of a further embodiment of a hinge according to the invention;

FIG. 29 is a plan view of the tilting lever of this embodiment;

FIG. 30 is a section view along line XXX—XXX;

FIG. 31 is a plan view of a hinge according to a further embodiment of this invention;

FIG. 32 is a plan view of the tilting lever of this embodiment; and

FIG. 33 is a sectional view along XXXIII—XXXIII of FIG. 31.

DESCRIPTION OF THE PREFERRED EMBODIMENTS

Figure 3:
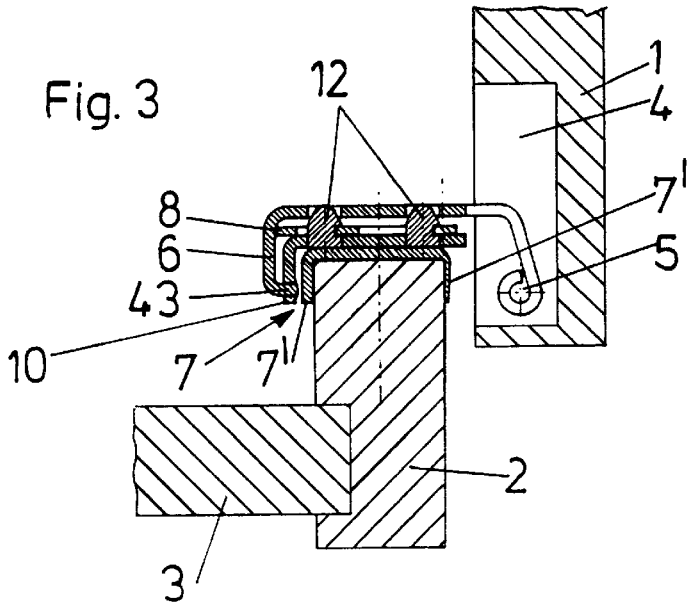
FIG. 3 is a section along line III—III of FIG. 1.
Figure 2:
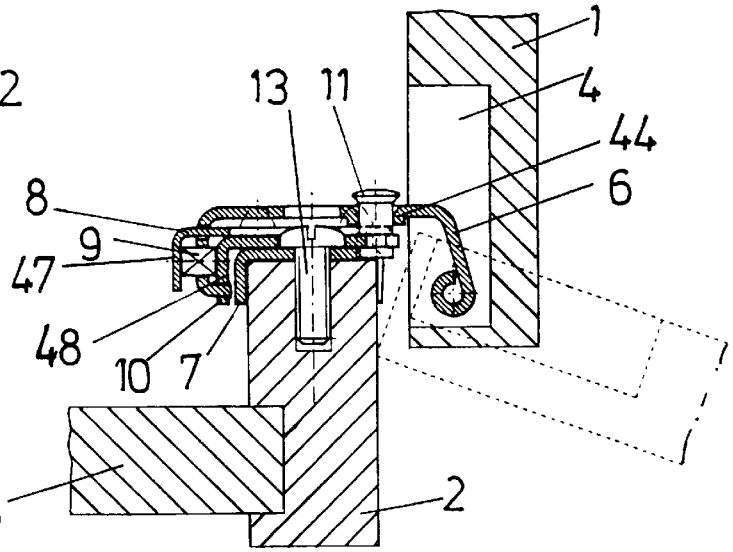
FIG. 2 is a section along line II—II of FIG. 1.

With a hinge according to the invention a mounting plate 7 and a hinge arm 6 are not directly fastened to a furniture side wall 3 but to a frame 2 which abuts the front face of the furniture side wall 3. A hinge casting 4 is mounted in a bore of a door 1 and is connected to the hinge arm 6 by means of a hinge axle 5.

In the embodiments according to FIGS. 1 to 24 there is provided a latching member as a slide 8. The mounting plate 7 is fastened to the frame 2 of the piece of furniture by means of a mounting screw 13. The mounting plate 7 is U-shaped and abuts the frame 2 on three sides thereof, whereby two longer side webs 7' abut the rear side and the front side of frame 2.

In a first embodiment the mounting plate 7 is provided with two pegs 12 for holding the hinge arm 6 on the mounting plate 5. The rear of hinge arm 6 is provided with a web 43 with which it is coupled to an intermediate plate 10. At the side where the hinge axle 5 is situated the intermediate plate 10 is provided with a slot in which a screw 11 is engaged for adjusting the gap of the door 1 with respect to the furniture side wall 3. The screw 11 is held in a female thread in the hinge arm 6 adjacent a side thereof. By turning the screw 11 the front end of the hinge arm 6 and the hinge axle 5 are moved with respect to the furniture side wall 3 in a direction perpendicular to the furniture side wall 3.

Both the hinge arm 6 and the mounting plate 7 are generally rectangular in shape as viewed in plan, and each has a pair of longer sides extending parallel to hinge axle 5 and a pair of shorter sides.

The slide 8 is situated between the intermediate plate 10 and the hinge arm 6. The slide 8 is provided with two hooks 45. In a locking position of the slide the hooks 45 engage in slots 46 of the pegs 12. The hooks 45 are directed to each other and bend around the pegs 12. The slide 8 has two arms 8', 8" extending at a right angle to each other, each arm being parallel to an edge of the mounting plate 7.

Figure 1:
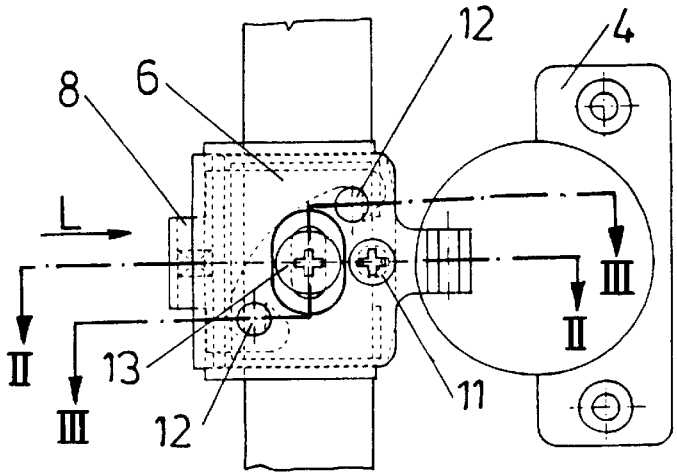
FIG. 1 is a plan view of an embodiment of a hinge according to the invention.
Figure 4:
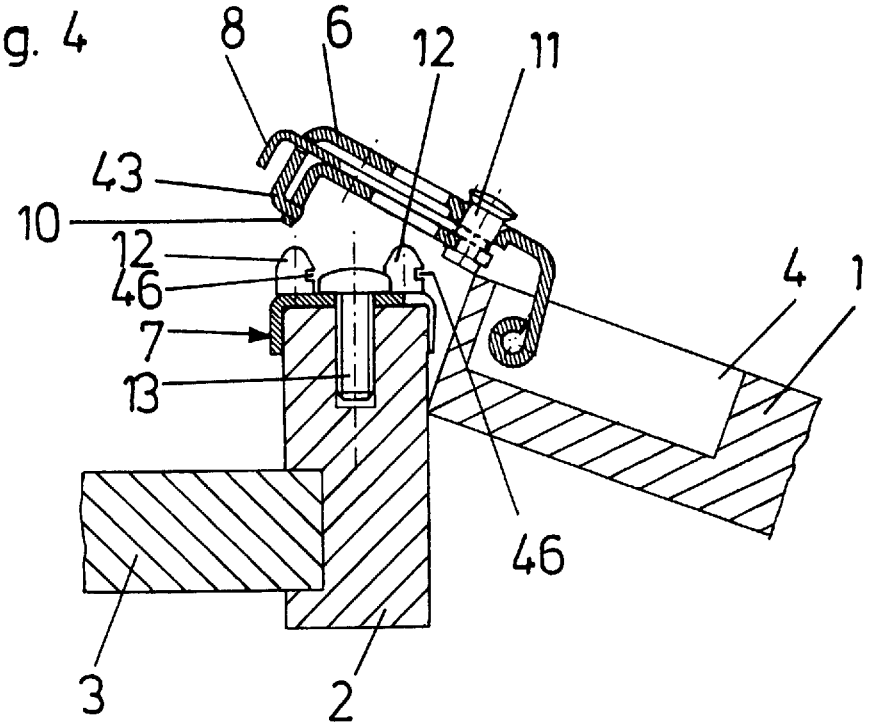
FIG. 4 is the same section as FIG. 2 but with a hinge arm removed from a mounting plate.
Figure 5:
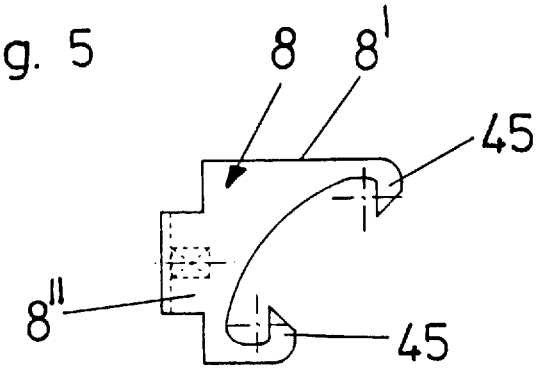
FIG. 5 is a plan view of a latching member in the form of a slide.
Figure 6:
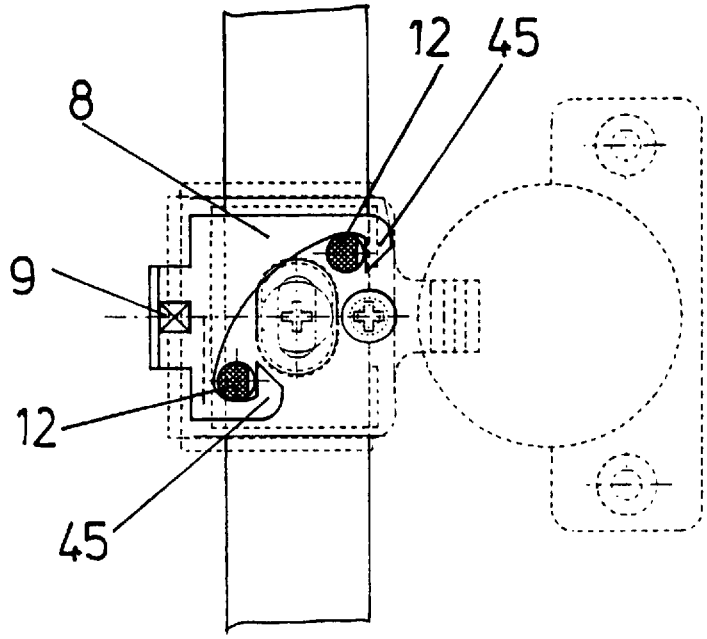
FIG. 6 is a schematic view of the latching member in a non-locking position.
Figure 7:
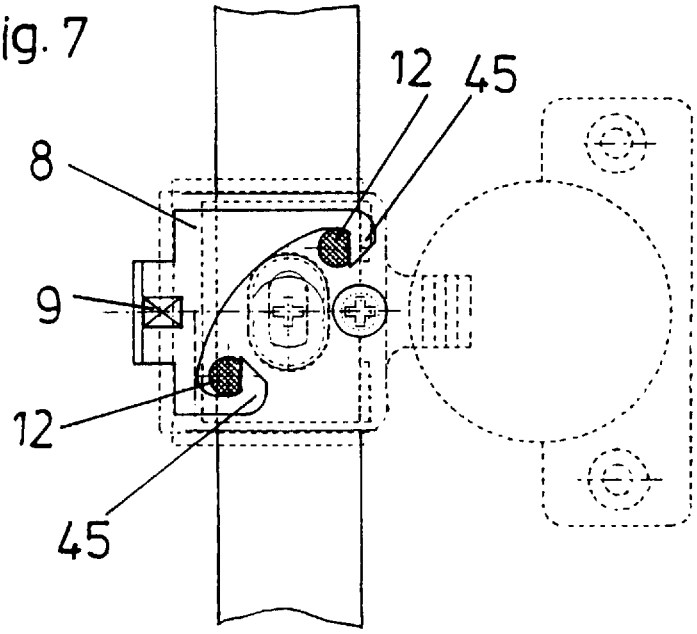
FIG. 7 is a schematic view of the latching member in a locking position.

The slide 8 is acted upon by a spring 9 which pushes the slide 8 into the locking position in which the hooks 45 are situated within the slots 46 of the pegs 12. This locking position is shown in FIGS. 1 and 7. The slide 8 is provided with a bent web 47. Spring 9 is situated between web 47 and a bent web 48 of the intermediate plate 10. The spring 9 can be a pressure spring and a helical spring. If pressure is exerted on the web 47 of the slide 8 in the direction of arrow L of FIG. 1 the hooks 45 of the slide 8 are moved out of the slots 46 of the pegs 12 and the hinge arm 6 can be removed from the mounting plate 7, whereby the intermediate plate 10 remains attached to the hinge arm 6.

Figure 9:
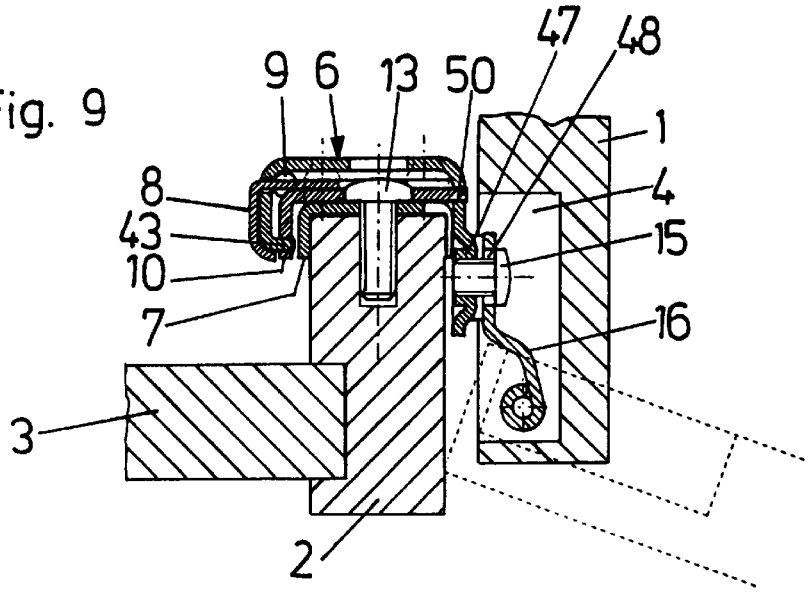
FIG. 9 is a sectional view of the hinge arm and the mounting plate.
Figure 8:
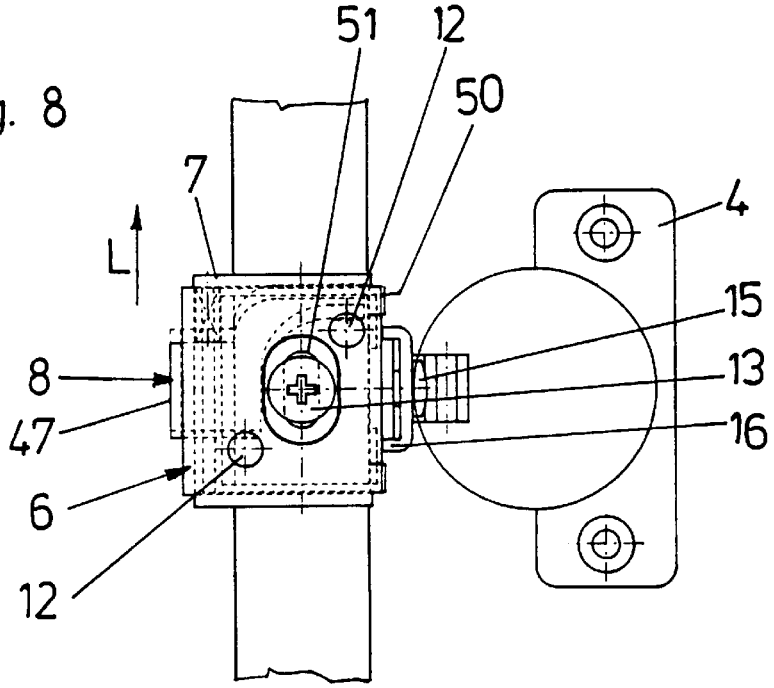
FIG. 8 is a plan view of a further embodiment of the hinge arm.
Figure 10:
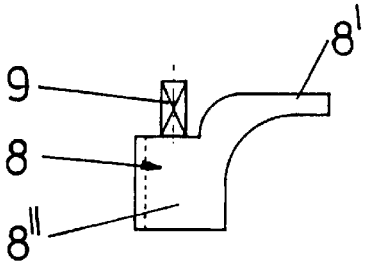
FIG. 10 is a schematic view of the slide and a spring.
Figure 11:
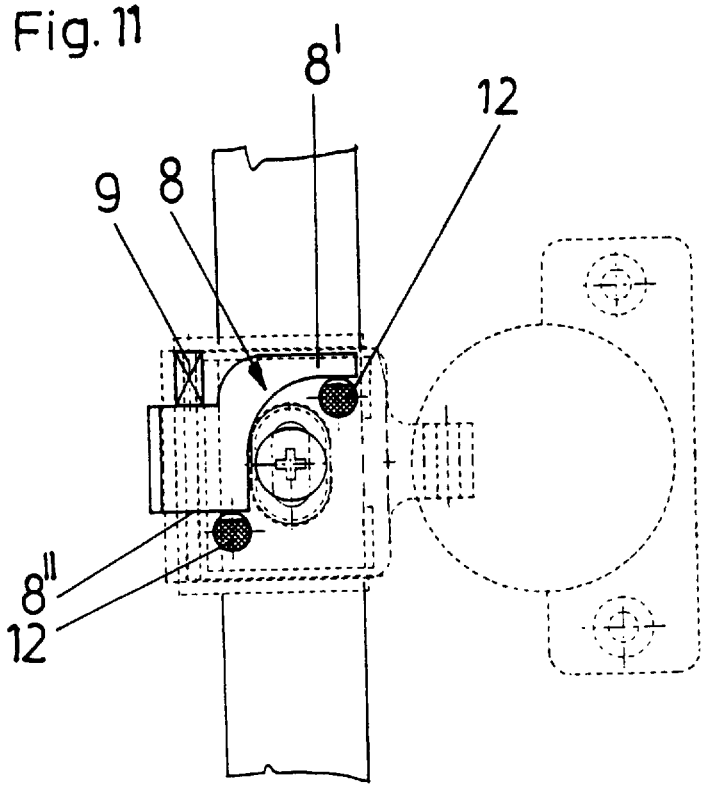
FIG. 11 is a schematic view of the slide in the non-locking position.
Figure 12:
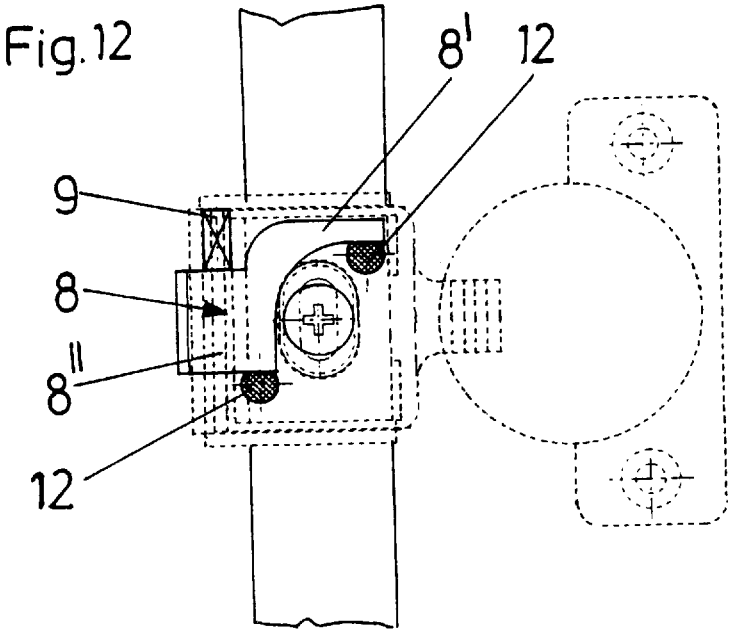
FIG. 12 is a schematic view of the slide in the locking position.
Figure 15:
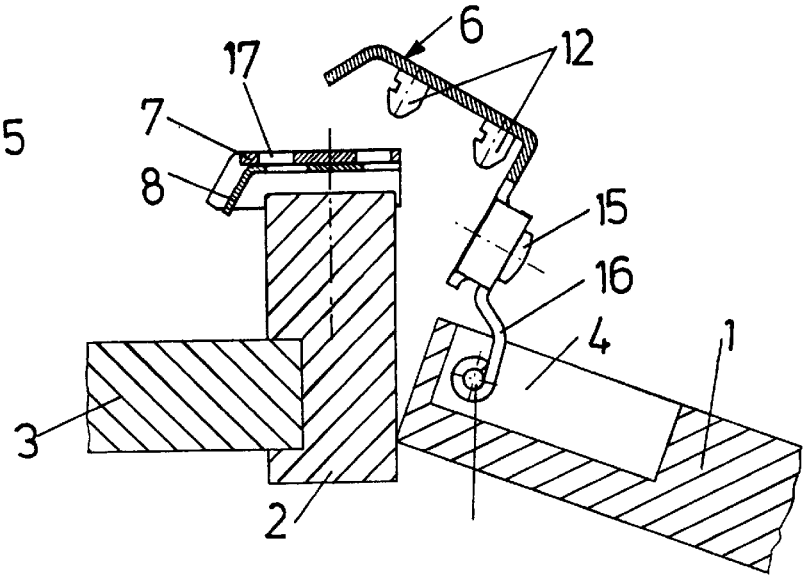
FIG. 15 is a sectional view along line XV—XV of FIG. 13.
Figure 14:
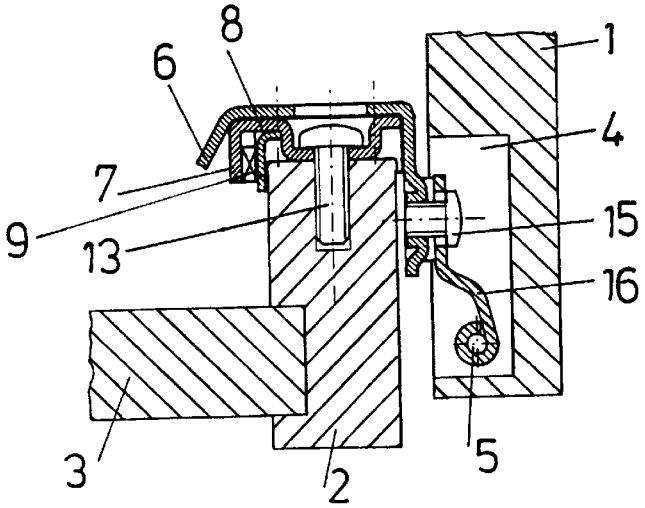
FIG. 14 is a sectional view along line XIV—XIV of FIG. 13.
Figure 16:
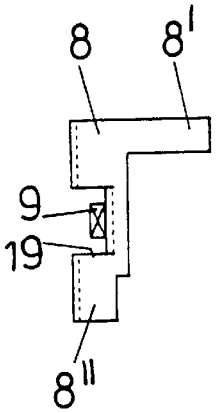
FIG. 16 is a schematic view of the slide and the spring according to this embodiment.
Figure 13:
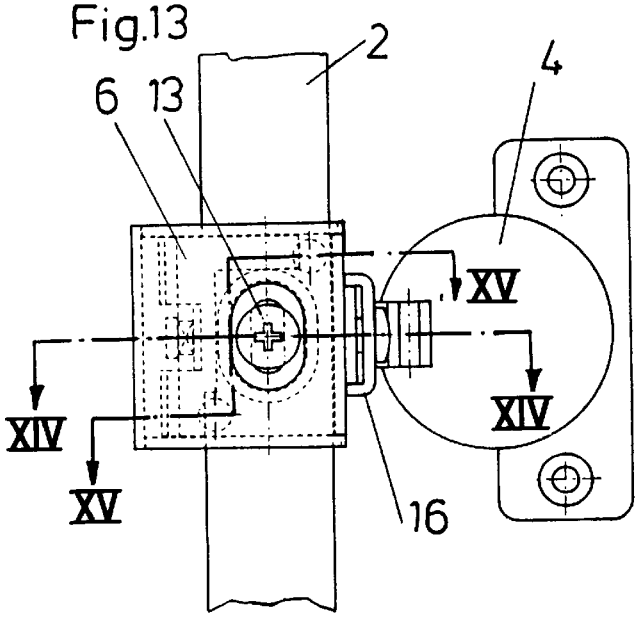
FIG. 13 is a plan view of the hinge according to a further embodiment of the invention.

According to the embodiment of the FIG. 8 and 9 the hinge arm 6 is connected to a separate arm 16 by means of a screw 15. The separate arm 16 is linked to the hinge axle 5. The hinge arm 6 is secured to the mounting plate 7 in the same way as described in the preceding embodiment. The screw 15 is held in a female thread in the hinge arm 6 and protrudes through a slot 48 in the arm 16. The arm 16 is clamped to the hinge arm 6 by means of the screw 15 and can be displaced over the length of the slot 18 in the arm 16. This displacement is in a direction perpendicular to the furniture side wall 3. The hinge arm 6 is again provided with a web 43 with which it is coupled to intermediate plate 10. On the side directed to the hinge axle 5 the intermediate plate 10 is provided with protrusions 50 which protrude into slots in the hinge arm 6. By means of these protrusions the hinge arm 6 and the intermediate plate 10 are coupled to each other.

The slide 8 which acts as a latching member is situated between the intermediate plate 10 and the hinge arm 6. The slide 8 is provided with two arms 8', 8" which in locking position rest in the slots 46 of the pegs 12. The slide 8 is displaceable in the direction of the height of the frame 2, whereby the spring 9 counteracts such displacement. The slide 8 is provided with a bent web 47 which acts as a handle and by which the slide 8 is moveable. The spring 9 is situated between the web 8" of the slide 8 and a web on the mounting plate 7. The spring 9 can be a pressure spring and a helical spring. If the slide 8 is moved in the direction of arrow L of FIG. 8 the arms 8', 8" are moved out of the slots 46 of the pegs 12 and the hinge arm 6 is removable from the mounting plate.

The mounting plate 7 is fastened to the frame 2 of the piece of furniture by means of fastening screw 13. The fastening screw 13 extends through a slot 51 in the mounting plate 7 so that the mounting plate 7 is adjustable over the length of the slot 51 and the position of the hinge arm 6 is adjustable in the direction of the height of the piece of furniture.

Figure 17:
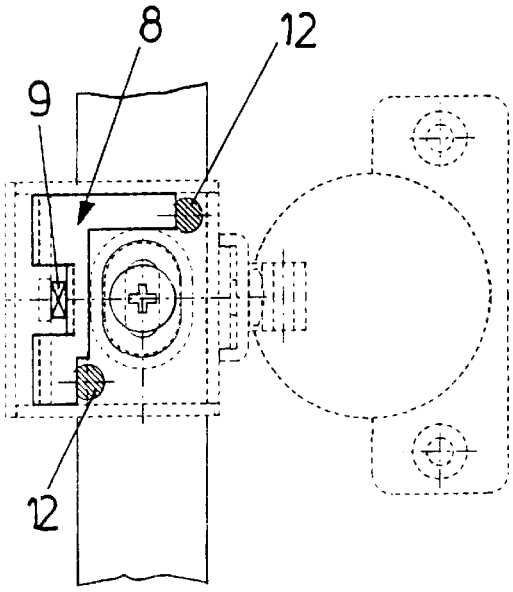
FIG. 17 is a plan view of a slide in the locking position.
Figure 18:
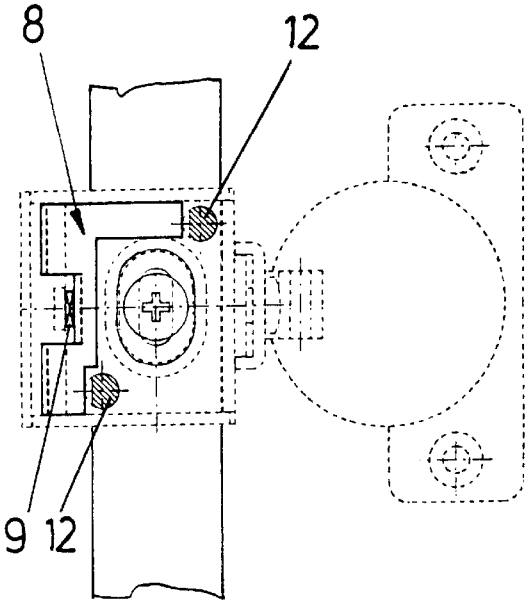
FIG. 18 is a plan view of the slide in the non-locking position.
Figure 19:
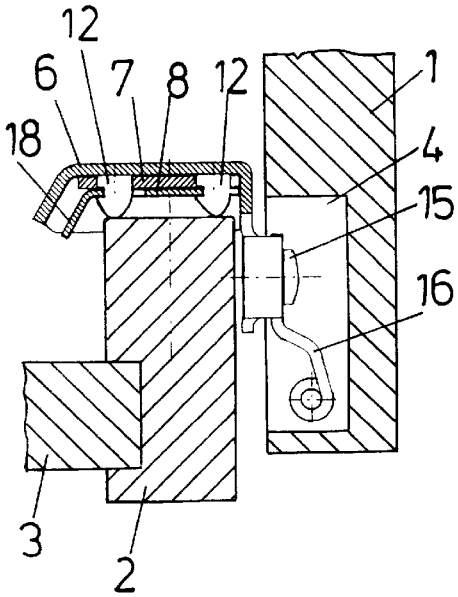
FIG. 19 is a sectional view of the hinge arm, the slide and the mounting plate whereby the slide is shown in the locking position.
Figure 20:
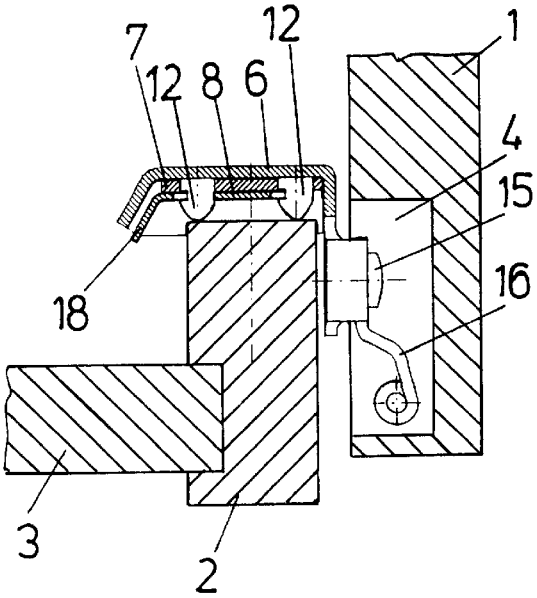
FIG. 20 is a sectional view of the hinge arm, the slide and the mounting plate whereby the slide is in the non-locking position.
Figure 21:
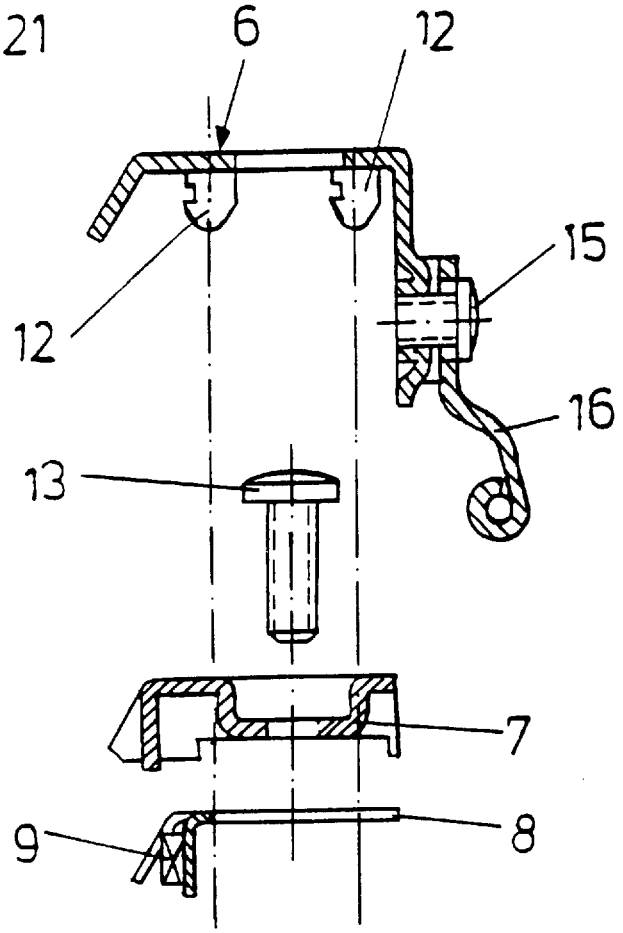
FIG. 21 is an exploded sectional view of the mounting plate, the slide and the hinge arm.

In the embodiment according to FIGS. 13 to 21 the hinge arm 6 is provided with pegs 12. The arm 16 which is linked to the hinge axle 5 is fastened to the hinge arm 6 by means of a screw 15. In the mounted position the pegs 12 extend through holes 17 in the mounting plate 7. The slide 8 is situated beneath the mounting plate 7 (with respect to the frame 2). As in the embodiment described before, the slide 8 is provided with two arms 8', 8". The slide 8 is acted upon by a spring 9 which is situated in a recess 19 of the slide 8. The spring 9 can be a pressure spring and a helical spring. The slide 8 is moveable perpendicularly to the closing plane of the door 1. FIG. 17 shows the locking position of slide 8 whereby the arms 8', 8" rest in the slots 46 of the pegs 12. The slide 8 is again provided with a bent web 18 acting as a handle. If the slide 8 is moved against the action of the spring 9 out of the position shown in FIG. 19 and into the position shown in FIG. 20, the slide 8 is removed from the pegs 12 and the hinge arm 6 can be removed from the mounting plate 7.

Figure 22:
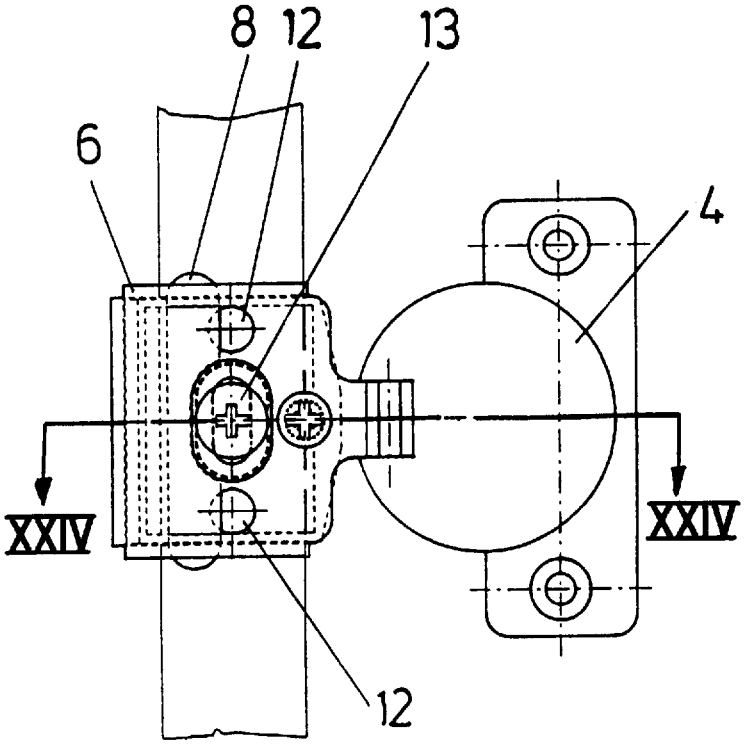
FIG. 22 is a plan view of a hinge according to a further embodiment of the invention.
Figure 23:
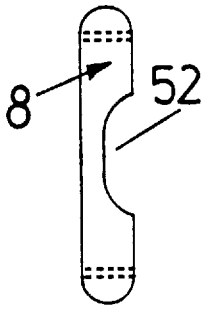
FIG. 23 is a plan view of the slide.
Figure 24:
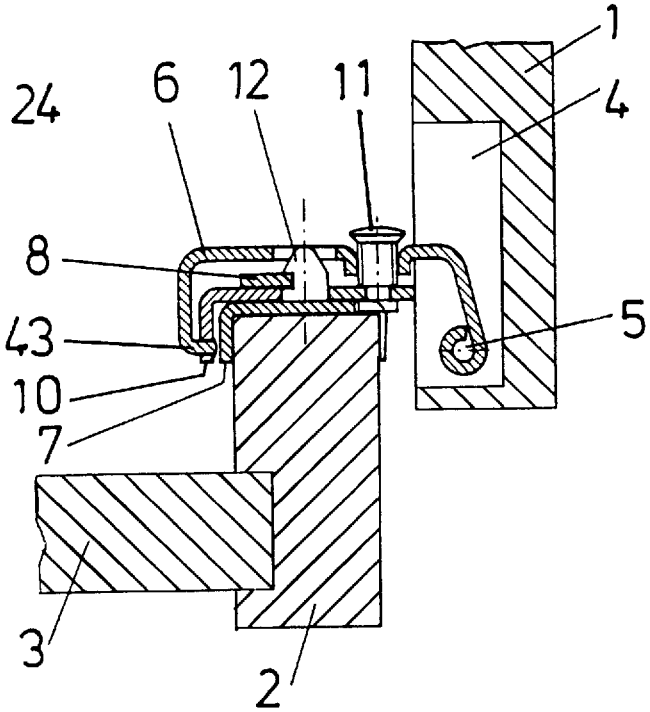
FIG. 24 is a sectional view along line XXIV—XXIV of FIG. 22.

In the embodiment according to FIGS. 22 to 24 the hinge arm 6 is also coupled to an intermediate plate 10 by means of a bent web 43 and a screw 11. The bent web 43 is situated behind the frame 2 and the screw 11 is situated at the front of the frame 2. The slide 8 which is positioned between the intermediate plate 10 and the hinge arm 6 is of longitudinal form and is aligned parallel to the hinge axle 5. A spring can be provided for acting on the slide 8 but such a spring is not necessary. The slide 8 can also be moved by hand into the locking position. As shown in FIG. 22 the ends of the slide 8 project from underneath the hinge arm 6 on two sides of the hinge arm 6 so that the slide 8 can be manually displaced by gripping the two ends. The slide 8 is provided with a recess 52 to accommodate the fastening screw 13.

In the embodiments of FIGS. 25 to 33 the latching member is constituted by tilting lever devices 33, 38, 41. Tilting lever devices 33, 38 are tiltable about an axle 37 which extends perpendicular to the mounting plate 7.

In the embodiments of FIGS. 25 to 30 the devices 33, 38 each include two separate tilting levers, both mounted on a common axle 37 similar to a pair of scissors. In both embodiments the pegs 12 are provided on the mounting plate 7 and they extend through an intermediate plate 10 to which the hinge arm 6 is coupled. The hinge arm 6 is, like in the before-mentioned embodiment, provided with a bent web 43 by means of which it is coupled to the intermediate plate 10 in the rear of the frame 2. A screw 11 is provided which is held in the female thread in the hinge arm 6 and by its screw head in a slot in the intermediate plate 10. Again two pegs 12 are provided. The tilting lever devices 33, 38 are two two-arm levers, one arm 33', 38' being the holding arm which rests in the slot 46 of the peg 12 and the other arm 33", 38" being the handle. In the embodiment according to FIG. 25, to release the hinge arms 6 from the mounting plate 7 the arms 33" of the tilting levers 33 are pressed towards the frame 2. In the embodiment according to FIG. 28 to 30, to release the hinge arm 6 from the mounting plate 7 the arms 38" of the tilting levers 38 are moved towards each other and brought into a position in which they overlap each other. In this way the arms 38' are removed from the slots 46 in the pegs 12.

In the embodiment of FIG. 31 to 33, a single tilting lever 41 is provided. The tilting lever 41 has two handle parts 41', 41". The handle parts 41' and 41" extend beyond opposite sides beyond the hinge arm 6. The tilting lever 41 is provided with an opening 42 surrounding the fastening screw 13. Further, the tilting lever 41 is provided with slots 48 each in the form of an arc and into which protrude guiding pegs 23 which are provided on the intermediate plate 10 or on the mounting plate 7. By means of the guiding pegs 23 and the slots 48, the stability of the tilting lever 41 is increased. Also in this embodiment, the mounting plate 7 is provided with two pegs 12 and in the locking position the tilting lever 41 rests with his handle members 41' and 41" in the slots 46 of pegs 12. By tilting the tilting member 14 clockwise, the hinge arm 6 is released from the mounting plate 7. Again the tilting lever 41 is situated between an intermediate plate 10 and the hinge arm 6. The hinge arm 6 is provided with a bent web 43 and a screw 11 by means of which it is coupled to the intermediate plate 10.

We claim:

1. A hinge for mounting a door to an article of furniture, said hinge comprising:

a hinge member fastenable to the door;

a hinge arm articulated to said hinge member by at least one hinge axle;

a mounting plate fastenable to a frame of the article of furniture;

each of said mounting plate and said hinge arm being of rectangular configuration and including a pair of first sides extending parallel to said hinge axle and a pair of second sides;

said mounting plate having extending transversely from along one of said first sides thereof an integral web to be abutted with the frame when said mounting plate is in a mounted position thereof;

at least one peg extending from said hinge arm or from said mounting plate, said peg having therein a slot; and a latching member mounted for movement in directions parallel to said mounting plate between a locking position, in which said latching member extends into said slot and thus locks said hinge arm to said mounting plate, and a non-locking position, in which said latching member is withdrawn from said slot and said hinge arm may be removed from said mounting plate.

2. A hinge as claimed in claim 1, wherein said mounting plate has extending transversely from along both of said first sides thereof respective integral webs to be abutted with the frame when said mounting plate is in the mounted position thereof.

3. A hinge as claimed in claim 1, wherein said first sides are longer than said second sides.

4. A hinge as claimed in claim 1, wherein said latching member comprises a tilting lever device pivotable about a pivot axis extending perpendicular to said mounting plate.

5. A hinge as claimed in claim 4, wherein said tilting lever device comprises two separate tilting levers, and two pegs extending from one of said hinge arm and said mounting plate, each said peg having therein a respective said slot into which is fittable to a respective said tilting lever.

6. A hinge as claimed in claim 5, wherein said two tilting levers are both pivotable about said pivot axis.

7. A hinge as claimed in claim 6, wherein said two tilting levers are pivotable away from each other to move into said non-locking position.

8. A hinge as claimed in claim 6, wherein said two tilting levers are pivotable toward each other to move into said non-locking position.

9. A hinge as claimed in claim 5, wherein said two tilting levers have angular end portions.

10. A hinge as claimed in claim 4, wherein said tilting lever device has therein a curved slot into which extends at least one guide peg projecting from said hinge arm or said mounting plate.

11. A hinge as claimed in claim 10, wherein said tilting lever device has extending from opposite sides thereof respective projecting handles.

12. A hinge as claimed in claim 1, further comprising a spring biassing said latching member to move toward said locking position.

13. A hinge as claimed in claim 1, wherein said latching member comprises a slide.

14. A hinge as claimed in claim 13, further comprising a spring biassing said slide to move toward said locking position.

15. A hinge as claimed in claim 14, wherein said spring comprises a helical pressure spring.

16. A hinge as claimed in claim 14, wherein said spring is positioned in a cutout provided in said slide.

17. A hinge as claimed in claim 13, comprising two pegs extending from one of said hinge arm and said mounting plate, each said peg having therein a respective said slot into which said slide is fittable.

18. A hinge as claimed in claim 17, wherein said slide has two hooks directed toward each other, said hooks fitting into respective said slots in said two pegs when said slide is in said locking position.

19. A hinge as claimed in claim 17, wherein said slide has two arms extending perpendicular to each other, said arms fitting into respective said slots in said two pegs when said slide is in said locking position.

20. A hinge as claimed in claim 13, further comprising an intermediate plate positioned between said hinge arm and said mounting plate.

21. A hinge as claimed in claim 20, wherein said intermediate plate is connected to said hinge arm.

22. A hinge as claimed in claim 21, further comprising a screw adjustably threaded into said hinge arm and having a head anchored in an opening in said intermediate plate, thereby connecting said intermediate plate to said hinge arm for relative adjustment therebetween.

23. A hinge as claimed in claim 20, wherein said hinge arm has a web connected to said intermediate plate.

24. A hinge as claimed in claim 20, wherein said slide is positioned between said hinge arm and said intermediate plate.

25. A hinge as claimed in claim 13, wherein said slide is positioned between said hinge arm and said mounting plate.

26. A hinge as claimed in claim 25, wherein said peg extends from said mounting plate.

27. A hinge as claimed in claim 13, wherein said mounting plate is positioned between said hinge arm and said slide.

28. A hinge as claimed in claim 27, wherein said peg extends from said hinge arm.

29. A hinge as claimed in claim 13, wherein said slide has a handle located adjacent one of said first sides of said hinge arm.

30. A hinge as claimed in claim 1, wherein said latching member has a handle located adjacent one of said first sides of said hinge arm.

31. A hinge as claimed in claim 1, wherein said hinge is articulated about said hinge axle by a separate arm that is adjustably connected to said hinge arm.

* * * * *